US006585233B1

(12) United States Patent
Sorben

(10) Patent No.: US 6,585,233 B1
(45) Date of Patent: Jul. 1, 2003

(54) ANIMAL-REPELLING APPARATUS

(75) Inventor: Donald R. Sorben, San Diego, CA (US)

(73) Assignee: Roll Guard, Inc., San Diego, CA (US)

( * ) Notice: Subject to any disclaimer, the term of this patent is extended or adjusted under 35 U.S.C. 154(b) by 39 days.

(21) Appl. No.: 10/029,615

(22) Filed: Dec. 20, 2001

Related U.S. Application Data

(60) Provisional application No. 60/257,530, filed on Dec. 22, 2000.

(51) Int. Cl.[7] ..... E04H 17/00
(52) U.S. Cl. ..... 256/12; 256/1
(58) Field of Search ..... 256/1, 11, 12, 256/65.07, 19

(56) References Cited

U.S. PATENT DOCUMENTS

| | | | | |
|---|---|---|---|---|
| 259,654 A | | 6/1882 | Worthington | |
| 321,171 A | | 6/1885 | Archibald | |
| 435,798 A | | 9/1890 | Poole | |
| 504,936 A | | 9/1893 | Niles | |
| 511,700 A | | 12/1893 | Jacobs | |
| 4,270,736 A | | 6/1981 | Burch | |
| 4,348,012 A | | 9/1982 | McLoughlin | |
| 5,143,354 A | | 9/1992 | Nolan | |
| 6,131,642 A | * | 10/2000 | Welfonder | 160/301 |
| 6,138,740 A | * | 10/2000 | Chou | 160/319 |
| 6,460,593 B1 | * | 10/2002 | Floyd | 160/370.22 |
| 2002/0069980 A1 | * | 6/2002 | Floyd | 160/370.22 |
| 2003/0015301 A1 | * | 1/2003 | Killo et al. | 160/310 |

FOREIGN PATENT DOCUMENTS

| | | |
|---|---|---|
| WO | WO 99/04117 | 1/1999 |

* cited by examiner

*Primary Examiner*—Lynne H. Browne
*Assistant Examiner*—John Cottingham
(74) *Attorney, Agent, or Firm*—Frank G. Morkunas

(57) ABSTRACT

An apparatus for repelling animals which is attachable to the top of any external barrier. The apparatus has an elongated hollow roller with an opening on each of its two ends; an end cap, with an aperture for receiving an axle, seated in a water-tight manner into each end of the roller; and a mounting member having an upper section with one or more axle projecting from it wherein the axles are adapted to insert into the aperture of the end cap and permit rotation of the roller and also having a lower section adapted to attach to an external structure. Noise-producing articles may be inserted into the hollow of the roller such that, as the roller is rotated, the movement of the articles within emit noise.

10 Claims, 2 Drawing Sheets

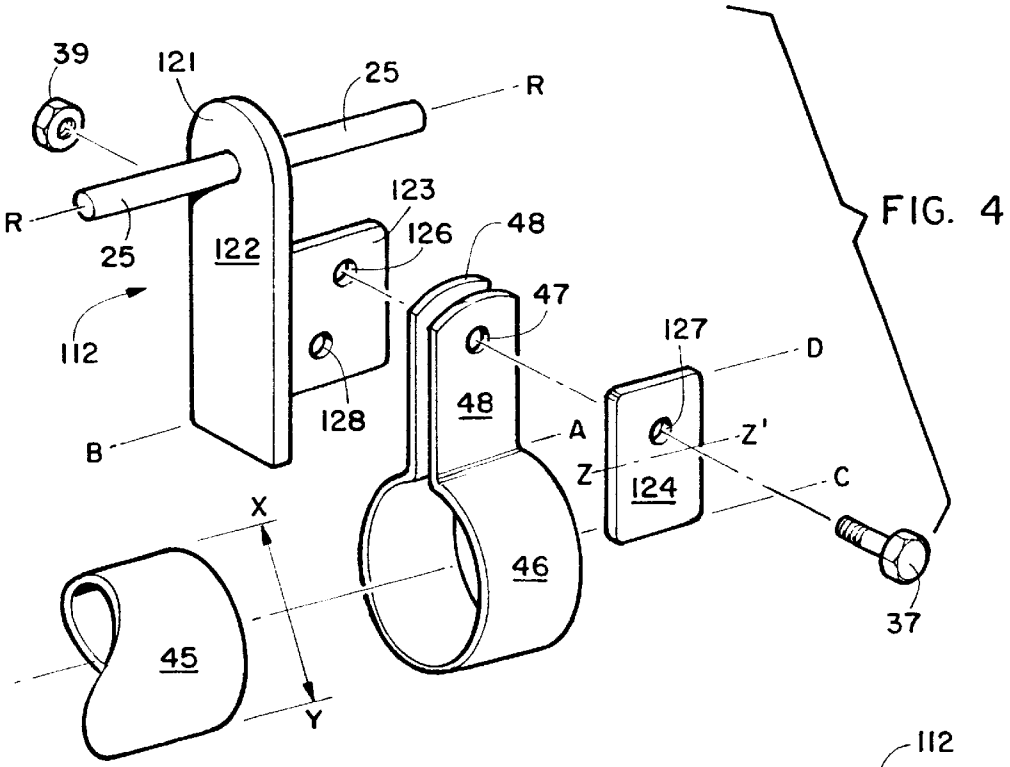
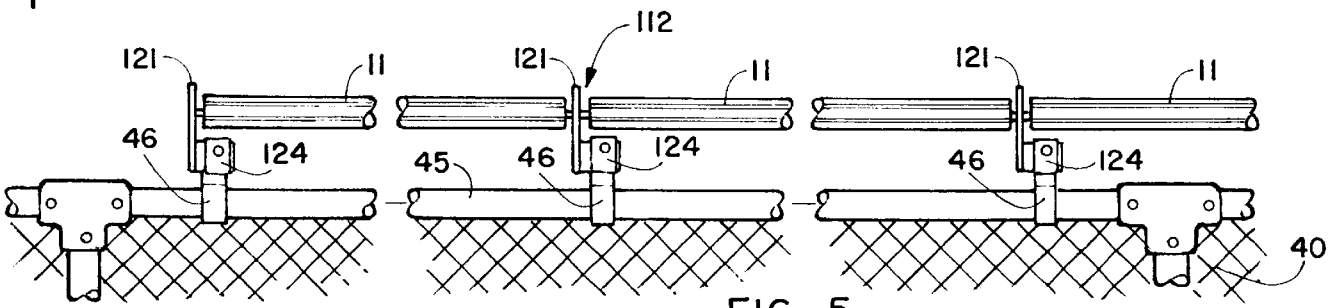
FIG. 5

ANIMAL-REPELLING APPARATUS

CROSS REFERENCES TO RELATED APPLICATIONS

This application claims the benefit of provisional application No. 60/257,530 filed Dec. 22, 2001.

BACKGROUND OF THE INVENTION

This present invention relates to an improvement in animal-repelling devices, and more particularly to animal-repelling devices mountable onto a boundary structure such as a fence or similar barrier designed to keep wild animals and uninvited domestic animals out.

With population growth continuing to tax urban environments for space, the countryside, near and outlying, have and are being developed. The more development encroaches upon the countryside, the more likely the development will see and experience wild-animal invasions to their property. Conventional fences and other border barriers are not sufficient to prevent wild animals from scaling the fence or barrier to enter the property; nor are they sufficient to prevent ones pet, such as a dog in particular, from scaling the fence or barrier to get out. Dangers abound with either scenario. The intrusion of a wild animal into one's backyard, in spite of a 'protective' fence places one's domestic pet and household member and guests at risk of harm and or disease. Property damage, eating up one's garden or a pet's food supply, are common with such intrusions. A pet dog escaping the comfort of a backyard exposes itself to the dangers of the wild and may never return as a result.

Several such repellers designed for boundary or barrier structures have been crafted and tried. Some are dangerous, lethal to a degree, having spikes, sharp objects, or barbed-wire on top. Some have a rotational function with or without dangerous objects on top. Most are complex in structure, assembly, and maintenance. What has been missing from this field of endeavor is a simply-designed apparatus which is easy to install, easy to maintain, low in cost, and aesthetically appealing. None has been as simple in construction as the present invention, none has been as easy to install and maintain as the present invention, none has been as aesthetic as the present invention, not all are harmless in structure and use as is the present invention, and none has been as effective as the present invention. Moreover, the present invention is mountable on virtually all types of fences and boundary barriers be they wooden fences, split-rail fences, chain-link fences, wrought-iron fences, or of masonry or other solid-like construction.

Accordingly, several objects and advantages of my invention are to:

(a) provide for an effective and safe animal-repeller for keeping unwanted animals out and domestic pets in;

(b) create an easy-to-maintain and easy-to-install animal-repeller which requires no special skill or tools to install;

(c) make an affordable animal-repeller or relatively simple construction;

(d) help maintain a safe environment for a person on their own property; and (e) protect domestic pets from harm causable by wild animals.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an apparatus, attachable to the top of an external barrier, for repelling animals. The apparatus has an elongated hollow roller with an opening on each of its two ends; an end cap, with an aperture for receiving an axle, seated into each end of the roller; and a mounting member having an upper section with one or more axle projecting from the upper section wherein the axles are adapted to insert into the aperture of the end cap and permit free rotation of the roller, and also having a lower section adapted to attach to an external structure such as a fence or other boundary barrier. The end caps secure the openings of the roller and prevent environmental contamination to the roller and the inner chamber. Noise-producing articles may be inserted into the hollow of the roller such that, as the roller is rotated, the movement of the articles within emit noise.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be made to the following detailed description taken in conjunction with the accompanying drawings in which:

FIG. 4 a detailed perspective view of another embodiment of the mounting bracket.

FIG. 5 is an elevation view of the apparatus mounted on a fence.

DETAILED DESCRIPTION OF THE INVENTION

Figures 1, 2, 3:
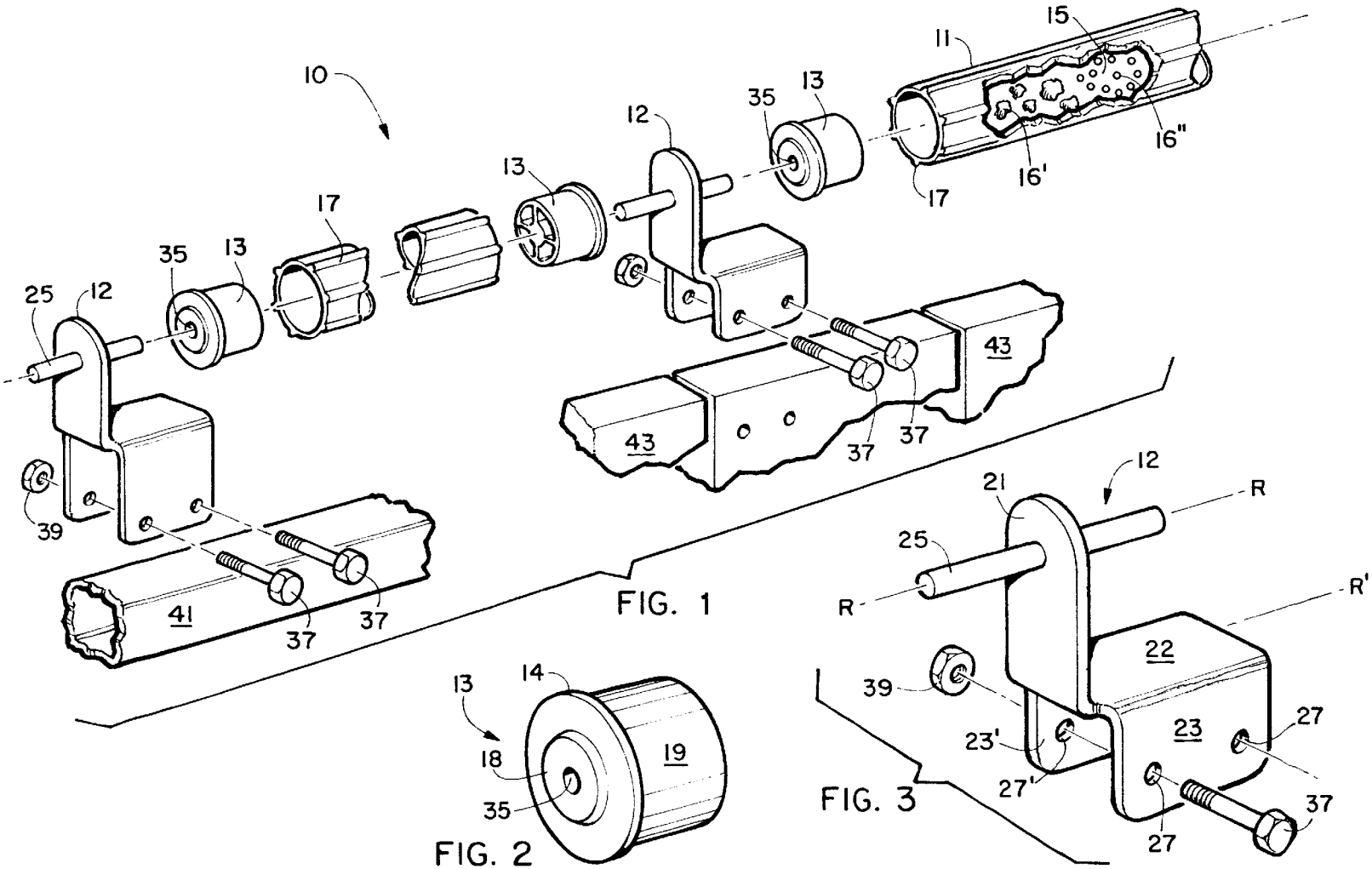
FIG. 1 is an exploded perspective view of the apparatus.
FIG. 2 is a detailed view of an end cap.
FIG. 3 is a detailed perspective view of one embodiment of the mounting bracket.

Referring now to the drawings in detail and in particular to FIG. 1, reference character 10 generally designates an animal-repelling apparatus constructed in accordance with a preferred embodiment of the present invention. The animal-repelling apparatus 10 of present invention comprises a roller 11 which is generally hollow inside thereby defining an inner chamber 15 therein. As illustrated, the roller 11 is elongated and is hollow though it may not necessarily be hollow. The preferred embodiment has a hollow roller 11. Ribs 17 longitudinally transverse the outer surface of the roller 11. Several such ribs 17 are on the outer circumference of the roller 11. Their function is multi-faceted: (1) to provide structural support for the roller 11, particularly when the roller 11 is relatively long; (2) to provide gripping capability or traction by and for an animal's paws when attempting to scale a fence upon which the present invention has been attached; and (3) to provide an aesthetically pleasing appearance to the apparatus 10 when viewed in its entirety.

An end cap 13 inserts into each end of the roller 11. The fit is a tight friction-fit which serves to prevent external matter, particularly water, from entering the inner chamber 15. Though the apparatus 10 may be used indoors or outdoors, its primary use generally will be outdoors. As such, it will be subject to the elements of the region; rain, snow, dust, and wind [environmental contamination]. The water-tight integrity of the end caps 13 inserted into each end of the roller 11 will prevent such intrusions and obviate damages to the apparatus associated therewith.

FIG. 2 illustrates the details of the end cap 13. The internal end 19 has a circumference and diameter nearly equal to, but slightly smaller than, the circumference and diameter of the inner chamber 15 of the roller 11. As such, it tightly and sealingly fits into the end of the roller 11 and functions as described above. A circumferential lip 14 encircles the internal end 19. The lip 14 has a diameter larger than the diameter of the internal end 19 and a diameter larger than the inside diameter of the inner chamber 15 of the roller 11. When the end cap 13 is inserted into the end of the roller 11, the lip 14 prevents the end cap 13 from inserting fully into the roller 11. On the external end of the end cap 13 [that which is exposed after the end cap 13 has been inserted into the end of the roller 11] is a step 18 having a diameter smaller than the diameter of the lip 14 and generally smaller than the diameter of the internal end 19. The diameter of the step 18 should generally be significantly smaller than the diameter of the lip 19. The step 18, with its smaller diameter and smaller surface area, facilitates rotation by reducing friction between the end caps 13 and the respective mounting members 12, 112 as the roller 11 rotates.

At the approximate center of the step 18 is an aperture 35. The aperture 35 is recessed well into the step 14 and into the internal end 19 of the end cap 13 but does not breach it. This aperture 35 is adapted to accept therein the axle 25 which extends from the mounting member or bracket member 12, 112 which allows for the rotation of the roller 11 when assembled and mounted on a suitable structure as an animal attempts to scale the structure.

FIGS. 3 and 4 illustrate the details of two embodiments of a mounting member 12, 112 respectively. FIG. 3 illustrates a mounting member with an upper section 21 and a lower section 22, 23. Upper section 21 is a relatively flat plate from which one or two axles 25 extend approximately perpendicularly therefrom. The axles 25 are adapted to insert into the aperture 35 of the end cap 13. The diameter of the axles 25 is slightly smaller than the diameter of the receiving aperture 35. For reference purposes, R represents the center of the axle 25 and R' represents the upper surface of lower section 22. For best animal-repelling results, the radius of the roller 11 [or roller 11 with ribs 17] should be as close to, but slightly shorter than, the distance represented by R–R' to allow for unimpaired rotation of the roller 11. The flat plate-like structure of the upper section 21 [as well as the second embodiment 121 thereof] eliminates or vastly minimizes, when the apparatus 10 is fully assembled, gaps between rollers 11 when more than one roller 11 comprises the apparatus 10. The smaller the gap between rollers 11, the less likelihood of an uninvited animal gaining a foothold between rollers 11 and the more functional the apparatus 10 for its designed purpose.

Extending laterally outward from the upper section 21 is a first plate-like member 22 which has at least one plate-like member 23 extending downward from the first member 22. Two such members 23, 23' as illustrated, are preferred. The first plate-like member 22 is approximately parallel to the axles 25 and approximately perpendicular to the upper section 21; the downward extensions 23, 23' are approximately perpendicular to the first member 22. Each downward extension 23, 23' has at least one aperture 27, 27'. Though one downward extension 23 with one aperture 27 will suffice for the intended purpose, two such downward extensions 23 with two apertures 27 and 23' with two apertures 27' aligned with the opposing apertures 27 of the opposing downward extension 23 is preferred since this will provide enhanced support; and in instances where the top of the external structure is a somewhat square-shaped rail, such will provide its major support.

With this embodiment of a mounting member 12, the apparatus 10 is applied to an external structure, such as a fence 40, a rail 41, or a flat surface 43 as follows. The mounting member 12 is first placed onto the top of the flat wood surface 43 [such as a flat wood fence section] with the first member 22 placed on the top of the flat wood surface 43. The two downward extensions 23, 23' prevent the mounting member 12 from falling off to either side. Using the apertures 27 as a guide, holes may be drilled through the external structure. If the top of the external structure is a somewhat square-shaped rail, generally no drilling is required. A suitable fastener, such as a bolt 37 is inserted through one aperture 27, through the external structure, past its corresponding aperture 27' on the opposing downward extension 23', and fastened thereat by a corresponding nut 39. If the external structure top is a somewhat square-shaped rail, the bolt generally will pass under the bottom of the rail.

With one such mounting member 12 in place, the aperture 35 of the end cap 13, which is in the roller 11, is inserted over one axle 25. When so inserted, that end of the roller 11 is held in place enabling the assembler to take a second mounting member 12 to the opposite end of the roller 11 and, with the roller thereat as a guide, insert the axle 25 of that second mounting member 12 into the aperture 35 of the end cap 13 on that end and then place the first member 22 of that second mounting member 12 onto the top surface of the external structure. No adjustments are necessary, no additional assistance is necessary, and no special tools or measuring devices are necessary. That second mounting member 12 is attached to the external structure in relatively the same manner as the prior mounting member 12.

The process is continued until the far ends of the external structure are reached. At that point, a mounting member 12 with either one or two axles 25 may be used to finish that side of the external structure. Because it is hollow, a roller 11 may easily be cut to fit as warranted and an end cap 13 forced into the cut end.

FIGS. 4 and 5 illustrate a second embodiment of a mounting member 112 mounted on a relatively tubular 45 external structure 40 such as the tube-type top section of a chain-link fence. Here a conventional relatively circular bracket 46, having two protrusions 48 extending outward from the point where the curvilineation terminates, is placed over the tube-like member 45 of the external structural. The outside diameter x-y of such members 45 generally is approximately between 1.00 inches to 1.25 inches, more or less. A circular bracket 46 compatible with the tube-like member 45 should be used. Each protrusion 48 of the circular bracket has an aperture 47 through the respective protrusion 48. For reference purposes, plane A represents that section where the curvilineation terminates and each protrusion 48 begins. The protrusions 48 should be pulled apart for placement of the circular bracket 46 onto the tube-like member 45. After the circular bracket 46 is so placed, the protrusions 48 should be 'pinched' close together and the mounting member 112 inserted between, or outside of, the two protrusions 48.

This mounting member 112 has, much like the previously described mounting member 12, a relatively flat plate-like upper section 121 from which one or two axles 25 extend approximately perpendicularly therefrom. These axles 25, like those on the previously described mounting member 12, are adapted to insert into the aperture 35 of the end cap 13. The diameter of the axles 25 is slightly smaller than the diameter of the receiving aperture 35. The lower section 122 extends downward from the upper section 121 and shares the same plane. The lower section 122 has a vertically extending extension 123 which has at least two apertures 124, 126 thereon with one aperture 126 being vertically disposed above the other aperture 124. In structure, therefore, the upper section 121 and the lower section 122 seemingly form a single flat plate-like structure with the vertical extension 123 being approximately perpendicular to the lower section 122 and, thereby, approximately parallel to the axles 25.

For reference purposes, the bottom of the vertical extension 123 is plane B. A detached plate-like member 124 completes the structure of this mounting member 112. The detached member 124 has at least one aperture 127 which is off-center as measured from horizontal centerline z–z'. For reference purposes the bottom of the detached member 124 is plane C and the top of the detached member 124 is plane D with the aperture 127 proximal to plane D. The off-centered aperture 127 permits two alternative planar alignments and height adjustability depending on the respective lengths of the protrusions 48 of two different circular brackets 46; i.e., where one set of protrusions 48 on one circular bracket 46 are longer than the set of protrusions 48 of another circular bracket 46. The first such alignment for longer protrusions 48 is between planes A, B, and C when a suitable fastener combination 37, 39 is inserted through apertures 127, 47, 126; or if the detached member 124 is inverted the second such planar alignment is between planes A, B, and D through apertures 127, 47, 128 when shorter protrusions 48 are involved.

When using this mounting member 112, for best animal-repelling results, the radius of the roller 11 [or roller 11 with ribs 17] should be as close to, but slightly shorter than the distance represented by R–B or R–A, to allow for unimpaired rotation of the roller 11.

With the present invention 10 attached to a fence, for example, when an animal, such as a coyote or other wild animal, a third-party's dog or cat, or any other non-invited animal attempts to scale the fence, as the animal jumps upward with front paws out-stretched, expecting to touch a stable top, the paws contact the roller 11 and, rather than finding a stable surface from which to cling and complete the jump over by bringing up the rear paws, the roller rotates toward the animal and the front paws roll down and off the roller 11 and the animal falls to the ground. In spite of repeated attempts, the animal cannot attain a stable surface from which to execute its necessary maneuvers to satisfactorily scale the fence. From these unsuccessful experiences our studies have shown that the animal, through learned behavior, will avoid that area in the future [even if the apparatus has been removed] and will instead seek out more 'friendly' grounds.

As previously described, the roller 11 has a hollow inner chamber 15. To further enhance the repellent-scope of the present invention, sound-making articles 16, such as, but not limited to, rocks 16, pebbles 16, roller bearings 16', metal or plastic fastener bolts 37, metal or plastic fastener nuts 39, and the like, may be placed into the inner chamber 15. As the roller 11 rotates, the movement of the sound-making articles 16 within will thereby emit rattling noises or other animal-unsettling noises.

Though not illustrated, a single roller 11 between two mounting members [12 or 112 or combinations thereof as the case may be] may comprise more than one section with each succeeding section telescoping into and out of another section. For example, a three-section single roller 11 may have a center section with two outer sections having outside diameters slightly smaller than the inside diameter of the center section. End caps 13 would be on each end of the outer sections. An internal compression spring in the inner chamber 15 exerts force outward forcing the outer sections to their fullest extension from the center section. In this embodiment, an assembler would first mount at least two respective mounting members 12 or 112 onto an external structure, fit the aperture 35 of one end cap 13 into the axle 25 of one mounting member 12 or 112. Then from the second mounting member the assembler would push an outer section inward toward the center section until the aperture 35 of the end cap 13 on that outer section can be placed over the axle 25 at that end. The force of the spring within, exerting its force outward maintains the multi-section roller 11 securely in place and facilitates its removal without need for tools.

The telescoping roller section could also be configured to telescope outward in one direction only with each succeeding section having a smaller diameter than the section from which it extends. For either embodiment of telescoping sections, a suitable sealing means between sections prevents environmental contamination within the inner chambers and a suitable stop means prevents the roller sections from completely separating from each other due to the outward force being exerted by the internal spring.

The present disclosure includes that contained in the present claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

The invention claimed is:

1. An animal repelling apparatus attached to a fence comprising:

(a) an elongated roller having an axis of rotation and further having two ends and an opening on each of its said two ends;

(b) an end cap having an internal end and an external end wherein said internal end of one of said end cap seats into one said opening of said roller and another of said end cap seats into a second opening of said elongated roller, said end cap further having an aperture on said external end wherein said aperture does not project through said internal end of said end cap; and (c) a mounting member having an upper section with one or more axle projecting therefrom adapted to insert into said aperture of said end cap and rotate freely therein and further having a lower section adapted to attach to an external structure.

2. The apparatus as claimed in claim 1 wherein said lower section of said mounting member has a first member extending laterally from said upper section and at least one extension on said first member, said at least one extension extending downward from said first member.

3. The apparatus as claimed in claim 2 wherein said at least one downward extension further comprises at least one aperture adapted to receive an external fastener through said at least one aperture for fastening said mounting member to said external structure.

4. The apparatus as claimed in claim 1 wherein said lower section of said mounting member is planar to said upper section and said one or more axle is approximately perpendicular to said upper section, said lower section further having a vertical extension thereon approximately parallel to said one or more axle and approximately perpendicular to said lower section, said vertical extension having at least two apertures thereon, said mounting member further comprising a detached plate having a top, a bottom, and an off-centered aperture in between said top and said bottom whereby when said off-centered aperture is aligned with one of said at least two apertures of said vertical extension, said bottom of said plate is aligned with said bottom of said vertical extension and with a top plane of an external attaching member and when said off-centered aperture is aligned with another of said at least two apertures of said vertical extension said top of said plate is aligned with said bottom of said vertical extension and with a top plane of a different external attaching member.

5. The apparatus as claimed in claim 1 wherein said end cap further comprises a step on said external end of said end cap, said step having a width smaller than a width of said internal end.

6. The apparatus as claimed in claim 5 further comprising a lip around said end cap separating said step from said internal end; said lip having a width larger than the width of said internal end.

7. The apparatus as claimed in claim 1 wherein said elongated roller has a hollow inner chamber.

8. The apparatus as claimed in claim 7 wherein said inner chamber comprises sound-making articles to make noise as said roller is rotated.

9. The apparatus as claimed in claim 8 wherein said sound-making articles are selected from the group consisting of stones, ball-bearings, metal or polymer fastener bolts, and metal or polymer fastener nuts.

10. The apparatus as claimed in claim 1 wherein said roller further comprises a plurality of longitudinal ribs around said roller.

* * * * *